United States Patent [19]

Boden

[11] Patent Number: 4,685,676

[45] Date of Patent: Aug. 11, 1987

[54] RACQUET STRUCTURE

[76] Inventor: Robert O. Boden, 1580 Gaywood Dr., P.O. Box 441, Altadena, Calif. 91001-0441

[21] Appl. No.: 824,161

[22] Filed: Jan. 30, 1986

[51] Int. Cl.[4] ..... A63B 49/00

[52] U.S. Cl. ..... 273/73 D

[58] Field of Search ..... 273/73 D, 73 R, 73 C, 273/73 E

[56] References Cited

U.S. PATENT DOCUMENTS

| | | | |
|---|---|---|---|
| 455,632 | 7/1891 | Mailings | 273/73 D |
| 1,132,214 | 3/1915 | Ries et al. | 273/73 D |
| 3,834,699 | 9/1974 | Pass | 273/73 D |
| 3,921,979 | 11/1975 | Dischinger | 273/73 R |
| 3,999,756 | 12/1976 | Head | 273/73 C |
| 4,013,289 | 3/1977 | Kaminstein | 273/73 D |
| 4,033,582 | 7/1977 | Linden | 273/73 D |
| 4,172,596 | 10/1979 | Linden | 273/73 D |
| 4,190,249 | 2/1980 | Fischer | 273/73 D |
| 4,231,575 | 11/1980 | Kutt et al. | 273/73 D |
| 4,249,731 | 2/1981 | Amster | 273/73 D |
| 4,273,331 | 6/1981 | Fischer | 273/73 D |
| 4,299,385 | 11/1981 | Boden | 273/73 D |
| 4,458,898 | 7/1984 | Boden | 273/73 D |

FOREIGN PATENT DOCUMENTS

| | | | |
|---|---|---|---|
| 2634599 | 2/1978 | Fed. Rep. of Germany | 273/73 D |
| 2656082 | 6/1978 | Fed. Rep. of Germany | 273/73 D |
| 2730739 | 1/1979 | Fed. Rep. of Germany | 273/73 D |
| 855902 | 2/1940 | France | 273/73 D |
| 901279 | 10/1944 | France | 273/73 D |
| 5248 | of 1880 | United Kingdom | 273/73 D |
| 143481 | 5/1920 | United Kingdom | 273/73 D |
| 300700 | 11/1928 | United Kingdom | 273/73 D |

*Primary Examiner*—Anton O. Oechsle
*Assistant Examiner*—Matthew L. Schneider
*Attorney, Agent, or Firm*—William P. Green

[57] ABSTRACT

A racquet having interwoven longitudinal and transverse strings, with most of the transverse strings being arranged in pairs in a pattern locating the two transverse strings of each pair in close proximity to one another, and with successive pairs being spaced apart a distance greater than the individual strings of a pair. The two strings of each pair of transverse strings are interwoven with the longitudinal strings in phase with one another, so that both of the strings of the pair are received at the same side of each longitudinal string. In conjunction with this stringing pattern, there is provided at least one elongated positioning element associated with and closely adjacent one of the pairs of transverse strings and extending therewith past a series of longitudinal strings and having locating surfaces acting to block lateral deflection of the longitudinal strings. In the preferred form of the invention, the positioning element is received between two associated transverse strings, in engagement therewith, and contains notches in which the longitudinal strings are seated and by which they are located and two elongated grooves in which the two associated transverse strings are seated and by which they are also located.

8 Claims, 8 Drawing Figures

L1
L10
L11
L12
L13
L14
L16
T6
T7
T8
T9
T10
P2
P3
12
18
28
29
30
31
32
33
34
S
s
d
θ
3
4
5
6A
6B

RACQUET STRUCTURE

BACKGROUND OF THE INVENTION

This invention relates to improved stringing arrangements for tennis racquets or other similar racquets.

My U.S. Pat. Nos. 4,299,385 issued Nov. 10, 1981 on "Racquet" and 4,458,898 issued July 10, 1984 on "Racquet With String Positioning Elements" show certain unique racquet stringing patterns in which interwoven longitudinal and transverse strings are preferably so arranged that the strings of one set, desirably the transverse strings, are spaced far enough apart to allow increased lateral deflection of intermediate portions of the other strings (preferably the longitudinal strings) in a manner increasing the spin forces which can be applied to a ball and otherwise improving control of the ball upon impact. The arrangements of these prior patents include positioning elements which are utilized in conjunction with the strings and which engage the strings of one set, desirably the longitudinal strings, in locating relation to prevent substantial lateral deflection of those strings at the locations at which they cross the strings of the other set, and thus reduce wear of the strings at their intersecting or contacting locations while avoiding interference with the discussed desired lateral deflection intermediate those points. In U.S. Pat. No. 4,299,385, each of these positioning elements is illustrated as located between two transverse strings which are interwoven with the longitudinal strings in an out of phase relation, that is, a pattern in which one of the two transverse strings is received in front of a particular longitudinal string and the other transverse string is received behind that same longitudinal string. In U.S. Pat. No. 4,458,898, the positioning elements as shown in the drawings are tubular and disposed about the transverse strings and contain notches for receiving and locating the longitudinal strings.

SUMMARY OF THE INVENTION

A major purpose of the present invention is to provide an improved arrangement of the above discussed general type in which increased spin forces and more effective control of a ball can be obtained than with a conventional racquet, but in which the 'feel' of the racquet as it contacts the ball remains approximately the same as with a conventional racquet. This permits a player to switch from a conventional racquet to a racquet embodying the present invention without noticing any substantial difference in the forces to which the racquet and player are subjected upon impact, while at the same time imparting to the ball the above discussed enhanced spin and control characteristics.

To achieve these results, a racquet embodying the present invention utilizes a novel stringing pattern including interwoven longitudinal and transverse strings having the strings of one of set (preferably the transverse strings) arranged in spaced pairs, and having at least one elongated positioning element associated with one of those pairs of strings. Preferably, such a positioning element is provided in association with each of the pairs of strings. The strings of each pair are in close proximity to one another, with successive pairs being spaced apart a distance greater than the individual strings of a pair.

The two strings of an individual one of these pairs of strings are interwoven with the second set of strings in phase with one another, that is, with both strings of the pair being received at the same side of each string of the other set. This in-phase relationship allows the two strings of the pair to run as close as possible to each other throughout their entire lengths. The conventional 180° out-of-phase relationship does not allow the two strings of the pair to achieve nearly the same degree of closeness. The elongated positioning element which coacts with that pair of strings extends with those strings past a series of the crossing strings of the other set, and has locating surfaces receivable in the path of and acting to block deflection of those strings of the other set at the locations at which the strings cross one another, to thus prevent substantial wear of the strings at the crossing locations.

In the preferred form of the invention, each such positioning element is located between and engages the two strings of the pair with which it is associated, and contains notches in which the strings of the other set are seated in locating relation and two elongated grooves in which the two strings of said pair are also seated in locating relation.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
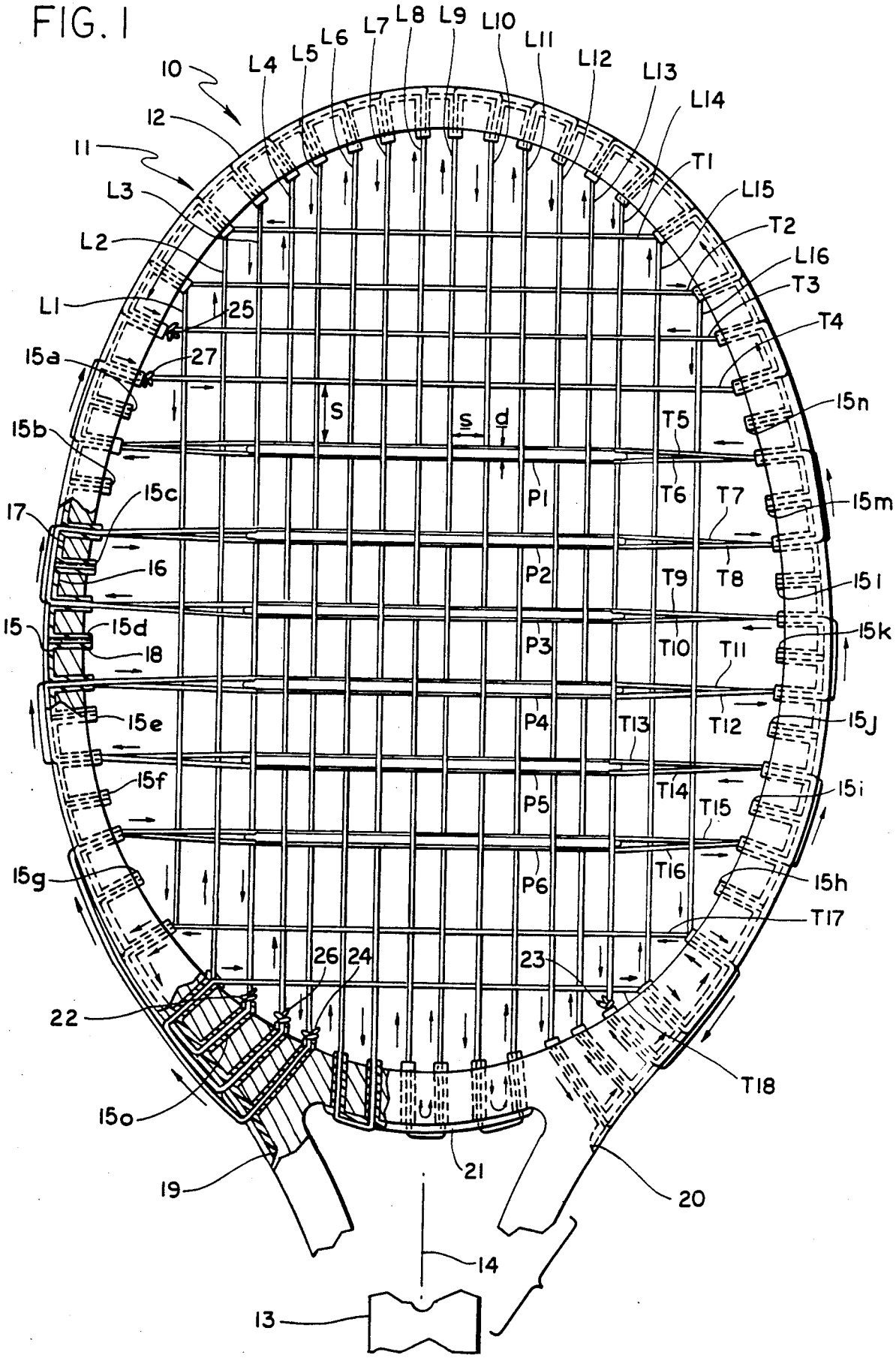
FIG. 1 is a front elevational view, partially broken away in section, of the preferred form of tennis racquet embodying the invention.

The tennis racquet 10 of FIGS. 1 through 5 includes a racquet body 11 with a loop portion 12 and a handle 13 projecting from loop 12 along longitudinal axis 14 of the racquet. This body 11 carries a set of longitudinal strings, typically 16 such strings, identified in FIG. 1 as strings L1, L2, L3, etc., and a set of transverse strings T1, T2, T3, etc. A series of positioning elements P1, P2, P3, P4, P5 and P6 are associated with the transverse strings and act to restrain the longitudinal strings against lateral deflection at the locations at which they cross the transverse strings.

The longitudinal and transverse strings may be attached to the body by extension through openings 15 formed at spaced locations about the periphery of loop portion 12 of body 11. A grommet strip 16 may be received within a peripheral groove or recess 17 formed in the outer surface of loop portion 12 of the body, and may have tubular portions 18 projecting inwardly within openings 15. Grommet strip 16 may extend almost entirely about the loop portion 12 of the handle, from a first end 19 of the strip at the left side of the handle in FIG. 1 to a second end 20 at the right side of the handle in that figure. The body itself may be molded of graphite or other material which could damage the strings in the absence of grommet strips 16. A second grommet strip 21 is provided at the lower central portion of loop 12, to engage and prevent damage to the strings at that location. The arrangement of openings 15 in racquet body 11 may typically be identical with the arrangement of the string retaining openings in a conventional racquet, and similarly the grommet strips 16 and 21 may be identical with those employed in a conventional racquet, but with certain of the openings 15 and contained tubular portions 18 of grommet strip 16 preferably being unused (as for instance at the locations of openings 15*a*, 15*b*, 15*c*, 15*d*, etc. through 15*n* in the preferred stringing pattern illustrated in FIG. 1).

All of the longitudinal strings L1, L2, L3, etc. may be formed of a single length of nylon, gut, or other stringing material, having its opposite ends tied off at 22 and 23. This material may be considered as extending first upwardly to form string L8, then out one of the openings 15 at the top of the racquet and into the next opening to form the second string L7, then from one opening to the next at the bottom and upwardly to form string L6, etc. until string L1 is formed at the left side of the racquet. Strings L9 through L16 are formed in a similar manner. At the lower end of string L1, the stringing material extends outwardly through one of the openings 15 and then into another of the openings (designated 150 in FIG. 1) to be tied off around string L3 as shown. Similarly, at the lower end of string L16 the second end of the stringing material extends outwardly through one of the openings 15 and back into another of the openings to be tied off about string L14 at 23. These knots at 22 and 23 are larger than the tubular portions 18 of the grommet strip 16 to prevent the knots from being pulled laterally outwardly therethrough. In attaching the longitudinal strings to the racquet body in the discussed pattern, strings L3 through L14 are seated in notches in positioning elements P1, P2, P3, P4, P5 and P6 as will be brought out in greater detail at a later point.

In a central region of the racquet, the transverse strings are arranged in pairs, with the two strings of each pair received in close proximity to one another and extending through the same openings in the racquet body, and with successive pairs being spaced apart a distance substantially greater than the distance between the two strings of a pair. The pairs are preferably spaced apart approximately twice as far as are successive transverse strings in a conventional racquet. In FIG. 1, the two strings T5 and T6 form such a pair of closely spaced transverse strings, as do strings T7 and T8, T9 and T10, T11 and T12, T13 and T14, and T15 and T16. The strings T1, T2, T3 and T4 above the top pair of transverse strings T5 and T6 may be individual non-paired strings, as may the lower strings T17 and T18 beneath the bottom pair of transverse strings T15 and T16.

The transverse strings may be formed of one or more lengths of stringing material threaded back and forth across the racquet body in any manner which will attain the illustrated pattern of strings. Preferably, two lengths of such stringing material are employed, with one of these lengths being tied off at the lower end of longitudinal string L4 at 26, and with the stringing material then extending outwardly through the tubular portion 18 of the grommet strip at that location and then upwardly along the exterior of the grommet strip and inwardly at a higher opening 15 to form transverse string T18. At the right end of that string T18, the material may extend upwardly to the next successive opening 15 and leftwardly to form string T17. At the left end of string T17, the stringing material may extend upwardly past one of the openings 15 to the next successive opening and then rightwardly to form string T15. By weaving back and forth in this manner and skipping certain of the openings 15, this length of stringing material may form successively transverse strings T18, T17, T15, T13, T11, T9, T7, T4, T3, T2, and T1, with the extremity of the material extending from the left end of string T1 outwardly through one of the openings 15 and the contained tubular portion 18 of the grommet strip, and then downwardly into another of the openings and tubular portions to be tied at its end to string T3 by a knot 25. Another length of stringing material may form the other transverse strings in a similar manner, with one end of that material being tied off at the lower end of longitudinal string L5 at 24. From this knot, the string material extends outwardly through the tubular portion 18 of the grommet strip at that location and to a higher tubular portion 18 at which the material extends inwardly to form transverse string T16. At the right end of string T16, the material may extend upwardly and then leftwardly to form string T14, then upwardly and rightwardly to form string T12, and similarly weave back and forth to form strings T10, T8 and T6. At the left end of T6, the extremity of this piece of material may extend outwardly through one of the tubular portions 18 of the grommet strip and then upwardly and inwardly through another of the tubular portions and be tied to the left end of string T4 by a knot 27.

The longitudinal and transverse strings are interwoven with one another as shown, with the two transverse strings of each pair (T5 and T6, T7 and T8, etc.) being interwoven with the longitudinal strings in phase with one another. That is, at the location at which any one of the pairs of transverse strings crosses one of the longitudinal strings, both of the transverse strings of that pair are received at the same side of that longitudinal string. For example, at the location at which the upper pair of strings T5 and T6 cross string L1, the two strings T5 and T6 are both located behind or at the rear side of string L1. At the location of the next successive longitudinal string L2, the two strings T5 and T6 are both received in front of that longitudinal string. Similarly, strings T5 and T6 extend behind string L3, in front of string L4, behind string L5, in front of string L6, behind string L7, etc.

The second pair of transverse strings T7 and T8 are similarly interwoven with the longitudinal strings L1, L2, L3, etc., but in a reverse manner, so that strings T7 and T8 are both received in front of the first longitudinal string L1, behind the next longitudinal string L2, in front of the next longitudinal string L3, behind string L4, in front of string L5, behind string L6, etc. The third pair of transverse strings T9 and T10 are interwoven with the longitudinal strings in the same manner as the first pair T5 and T6, that is, are received behind string L1, in front of string L2, behind string L3, etc. This alternating pattern continues through all of the paired transverse strings, with the fourth pair of strings T11 and T12 and the sixth pair of strings T15 and T16 corresponding to the second pair of strings T7 and T8, and with the fifth pair of strings T13 and T14 corresponding to strings T5 and T6 and strings T9 and T10.

Above and beneath the levels of the six pairs of transverse strings T5 through T16, the individual longitudinal and transverse strings are interwoven in conventional manner. More particularly, string L1 is received behind string T4 and in front of string T3, string L2 is received in front of string T4, behind string T3, and in front of string T2, string L3 is received behind string T4, in front of string T3, behind string T2 and in front of string T1. This interwoven pattern is continued across the entire width of the racquet, and at the locations of the two lowermost transverse strings T17 and T18.

By virtue of the fact that the pairs of transverse strings are located only at the locations of alternate ones of the openings 15 in the racquet body, with the intermediate openings such as those designated **15*b*, 15*c*, etc. being unused, the vertical spacing S between the successive pairs of transverse strings is substantially greater than the horizontal spacing s between successive longitudinal strings, and preferably is approximately twice the distance s across the entire central area within which positioning elements P1, P2**, etc. are located. The spacing S is also substantially greater than the spacing d between any two of the transverse strings of a particular one of the discussed pairs, desirably at least several times as great as the distance d.

Figures 2, 3, 4, 5, 6, 6A, 6B:
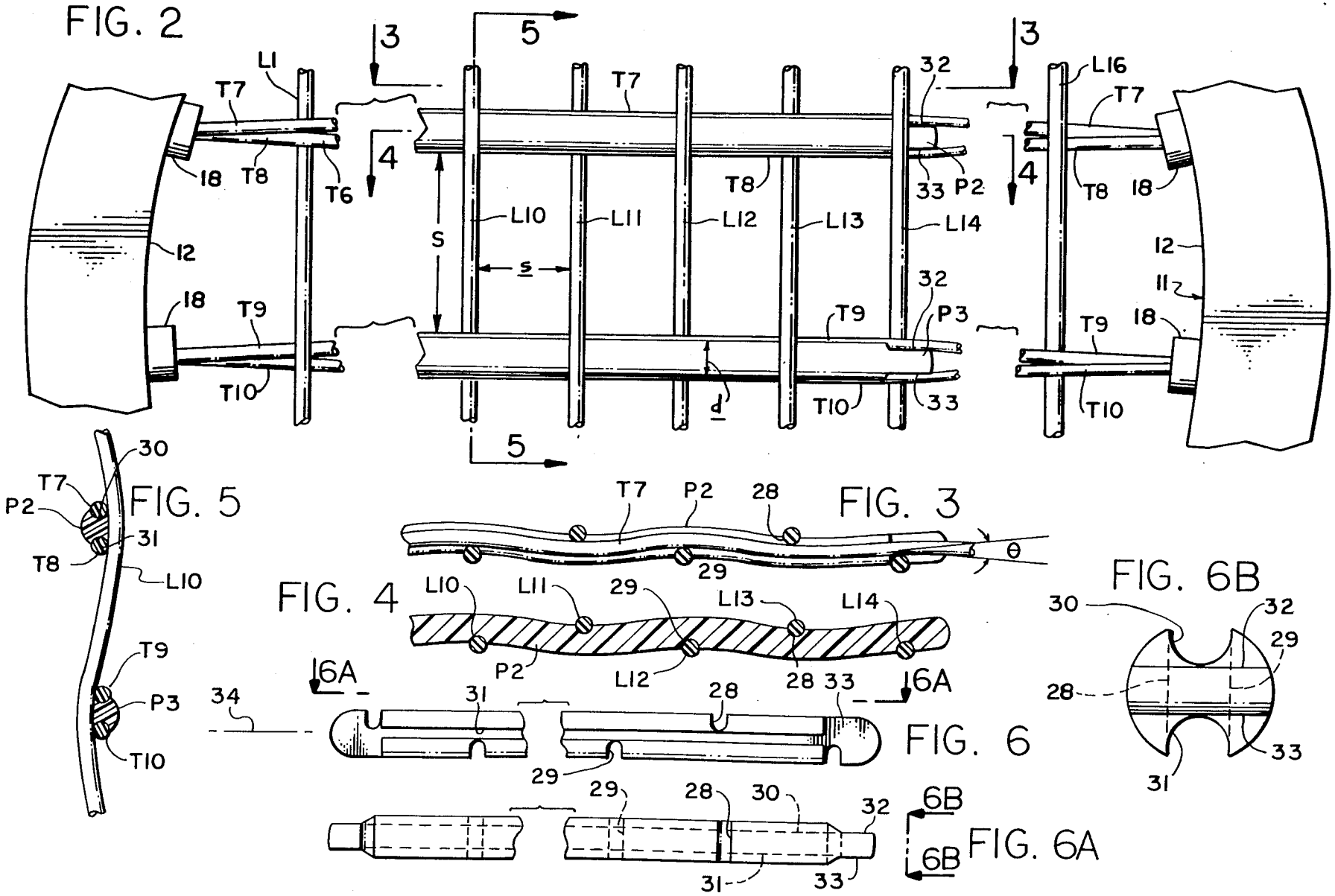
FIG. 2 is an enlarged fragmentary front elevational view corresponding to a portion of FIG. 1.
FIGS. 3 and 4 are fragmentary horizontal sections taken on lines 3—3 and 4—4 respectively of FIG. 2.
FIG. 5 is a fragmentary vertical section taken on line 5—5 of FIG. 2.
FIG. 6 illustrates one of the positioning elements as molded and before the strings are woven past it.
FIGS. 6A and 6B are additional views of the positioning element taken on lines 6A—6A and 6B—6B respectively of FIGS. 6 and 6A.

The positioning elements P1, P2, etc. are identical, and may each be molded as an integral elongated piece of resinous plastic material received and confined between the two strings of one of the pairs of transverse strings. For example, positioning element P2 is received vertically between strings T7 and T8, being in engagement at its upper side with string T7 and at its underside with string T8. At the locations of longitudinal strings L3 through L14, positioning element P2 contains staggardly-opposing notches 28 and 29 which may be semicircular and of a diameter just slightly larger than the diameter of the longitudinal strings, so that the longitudinal strings may be seated in these notches and be confined and located effectively thereby. The mutually-opposing elongated grooves 30 and 31 of element P2 are desirably semi-circular and of a diameter slightly larger that that of the transverse strings T7 and T8 seated therein. The grooves effectively block deflection of the two transverse strings relative to the positioning element in a direction perpendicular to both the longitudinal and transverse strings as can be seen from FIG. 5. The notches are desirably deep enough to allow the longitudinal strings seated therein to touch the two transverse strings seated in the grooves at the locations where the strings cross each other so as to urge the two transverse strings to remain seated in the grooves. The mutually-opposing semi-notches 32 and 33 (having one shoulder instead of two as in a full notch) at the opposite ends of element P2 as shown in FIGS. 2, 3 and 4 allow the transverse strings T7 and T8 to remain seated in grooves 30 and 31 regardless of the angle $\theta$ between the two transverse strings and the end portion of the positioning element. The resinous plastic material of element P2 has sufficient stiffness and strength to effectively resist lateral deflection of the longitudinal strings (in a left to right direction as viewed in FIG. 1) at the locations at which element P2 engages the longitudinal strings, under the influence of forces induced by contact with a ball. Similarly, the other positioning elements P1, P3, etc. prevent lateral deflection of the engaged longitudinal strings at the locations at which they contact those strings. However, vertically between the locations of positioning elements P1, P2, P3, etc. and the engaged pairs of strings, the longitudinal strings L3, L4, etc. may be deformed slightly transversely of their length when contacted with a ball, in a manner giving the ball spin characteristics.

The string T4 is desirably spaced above strings T5 and T6 a distance corresponding approximately to the spacing S, and similarly the string T17 is spaced at least about the same corresponding distance beneath the bottom pair of transverse strings T15 and T16. For this purpose, no transverse strings are provided at the opening 15 in the racquet body just above strings T5 and T6 or at the openings just beneath T15 and T16.

When initially molded, each of the positioning elements P1, P2, etc. may have the configuration illustrated in FIGS. 6, 6A and 6B, in which its elongated grooves are aligned with one another along a longitudinal axis 34, with the material of the positioning element being distortable slightly by the tension of the strings to the condition illustrated in FIG. 4 when the strings are pulled tight.

In stringing the racquet, the longitudinal strings $L_1$, $L_2$, $L_3$, etc. are first formed by weaving the stringing material forming these strings upwardly and downwardly as discussed and seating in the notches in the various positioning elements P1, P2, P3, etc. The transverse strings are then applied, weaving them in and out with respect to the longitudinal strings in the pattern discussed and illustrated in the drawings, and with the positioning elements being confined between the two strings of the various pairs of strings.

In use, the racquet has the same feel as a conventional racquet, since the number of longitudinal strings and the number of transverse strings may be exactly the same as in a conventional racquet. However, because of the arrangement of the transverse strings in pairs, with the pairs being spaced apart farther than in a standard racquet, the portions of the longitudinal strings between successive pairs of transverse strings are longer than the corresponding portions of the longitudinal strings in a standard racquet, and consequently these lengthened portions of the longitudinal strings (for example between strings T6 and T7, between strings T8 and T9, etc.) may be deflected or distorted laterally (in a left to right direction as viewed in FIG. 1) upon contact with the ball, to develop energy in the strings tending to return the strings to their straightened condition and impart spin forces to the ball. At the same time, however, the positioning elements P1, P2, etc. effectively retain the portions of the longitudinal strings contacted thereby against lateral deflection, and thereby prevent substantial deflection of the longitudinal strings at the locations at which they engage the paired transverse strings, to avoid frictional damage to the strings by virtue of relative motion at those contact areas.

In a variational form of the elongated positioning element (not shown), given a sufficiently strong and stiff resinous plastic material, the body of the positioning element shown in FIGS. 6, 6A and 6B may be reduced in transverse section along most of the length of those portions of the body between the crossing longitudinal strings on the same side of the body so as to effectively eliminate the grooves on said portions of the body and reduce the profile of said portions to that of the engaging transverse strings. In this case, the notches, in which the longitudinal strings are seated, are left undisturbed, but each elongated groove is broken down into a series of short semi-grooves at the locations where the strings cross each other, said semi-grooves having one shoulder (instead of two as in a full groove) engaging the associated transverse string so as to help prevent the positioning element from pulling away from the crossing longitudinal strings.

While certain specific embodiments of the present invention have been disclosed as typical, the invention is of course not limited to these particular forms, but rather is applicable broadly to all such variations as fall within the scope of the appended claims.

I claim:

1. A racquet comprising:

a racquet body having a loop portion and a handle portion projecting therefrom;

a set of first strings carried by said loop portion of the body and extending in a first direction;

a set of second strings carried by said loop portion of the body and extending in a second direction and crossing said first strings;

said first strings being arranged in pairs with the two strings of each pair being in close proximity to one another and with successive pairs spaced apart, along substantially their entire length, a distance greater than the individual strings of a pair;

said second strings being interwoven with said pairs of first strings so that an individual second string in extending past a series of pairs of first strings has portions received at different sides of different pairs of first strings, and a particular pair of first strings in extending past a series of second strings has portions received at different sides of different second strings;

the two strings of a pair of first strings being interwoven with said second strings in phase with one another so that both strings of the pair are received at the same side of each second string; and at least one elongated positioning element received between the two strings of a pair of said first strings and containing spaced notches in which said series of second strings is seated in locating relation and containing two elongated grooves in which the two strings of said pair of first strings are seated in locating relation.

2. A racquet comprising:

a racquet body having a loop portion and a handle portion projecting therefrom;

a set of transverse strings carried by said loop portion of the body and running parallel to the short axis of said loop;

a set of longitudinal strings carried by said loop portion of the body and running parallel to the long axis of said loop and crossing said transverse strings;

said transverse strings being arranged in pairs with the two strings of each pair in close proximity to one another and with successive pairs spaced apart, along substantially their entire length, a distance greater than the individual strings of a pair;

said longitudinal strings being interwoven with said pairs of transverse strings so that an individual longitudinal string in extending past a series of pairs of transverse strings is received alternately in front of and behind successive pairs of transverse strings, and a particular pair of transverse strings in extending past a series of longitudinal strings is received alternately in front of and behind successive ones of said longitudinal strings;

the two strings of each of said pairs of transverse strings being interwoven with said longitudinal strings in phase with one another so that both are received at the same side of each longitudinal string; and a plurality of elongated positioning elements each received between the two strings of a pair of said transverse strings and containing spaced notches in which said series of longitudinal strings is seated in locating relation and containing two elongated grooves in which the two strings of said pair of transverse strings are seated in locating relation.

3. A racquet as recited in claim 2, in which the two elongated grooves of each positioning element are broken up into a series of spaced semi-grooves, the body of said positioning element being reduced in transverse section along most of the length of those portions of said body between the crossing said longitudinal strings on the same side of said body so as to effectively eliminate the grooves on said portions and reduce the profile of said portions to essentially that of the engaging said transverse strings.

4. A racquet as recited in claim 2, in which the bottom of the notches in each positioning element intersects the nearer side walls of the two elongated grooves in said positioning element.

5. A racquet as recited in claim 2, in which the opposite end portions of each positioning element are so adapted as to allow the pair of transverse strings associated with the pair of elongated grooves in said positioning element to remain seated in said pair of elongated grooves regardless of the angle between said pair of transverse strings and said opposite end portions of said positioning element.

6. The combination of a stringing grid and a plurality of elongated positioning elements for use in a tennis racquet or the like, said combination comprising:

a set of transverse strings being arranged in pairs with the two strings of each pair being in close proximity to one another and with successive pairs spaced apart, along substantially their entire length, a distance greater than the individual strings of a pair;

a set of longitudinal strings being interwoven with said pairs of transverse strings so that an individual longitudinal string in extending past a series of pairs of transverse strings is received alternately in front of and behind successive pairs of transverse strings, and a particular pair of transverse strings in extending past a series of longitudinal strings is received alternately in front of and behind successive ones of said longitudinal strings;

the two strings of each of said pairs of transverse strings being interwoven with said longitudinal strings in phase with one another so that both are received at the same side of each longitudinal string; and a plurality of elongated positioning elements each received between the two strings of a pair of said transverse strings and containing spaced notches in which said series of longitudinal strings is seated in locating relation and containing two elongated grooves in which the two strings of said pair of transverse strings are seated in locating relation.

7. The combination as recited in claim 6, in which the depth of the elongated grooves of the positioning elements is reduced to zero and the gap between the shoulders at the top of each notch of the positioning elements is reduced to zero so that the longitudinal string seated therein is effectively blocked from moving in any direction transversely of its length at this location.

8. The combination as recited in claim 6, in which the bottom of the elongated grooves and notches of the positioning elements is essentially squared off in transverse section.

* * * * *